US009803957B2

(12) United States Patent
Chavira

(10) Patent No.: US 9,803,957 B2
(45) Date of Patent: Oct. 31, 2017

(54) FIREARM STORAGE APPARATUS

(71) Applicant: Carlos Chavira, Crystal Lake, IL (US)

(72) Inventor: Carlos Chavira, Crystal Lake, IL (US)

( * ) Notice: Subject to any disclaimer, the term of this patent is extended or adjusted under 35 U.S.C. 154(b) by 0 days.

(21) Appl. No.: 15/369,855

(22) Filed: Dec. 5, 2016

(65) Prior Publication Data

US 2017/0160053 A1 Jun. 8, 2017

Related U.S. Application Data

(60) Provisional application No. 62/262,441, filed on Dec. 3, 2015.

(51) Int. Cl.

| | |
|---|---|
| ***B60R 7/14*** | (2006.01) |
| ***F41C 33/06*** | (2006.01) |
| ***A45C 13/02*** | (2006.01) |
| ***A45C 13/10*** | (2006.01) |

(52) U.S. Cl.

CPC ..... *F41C 33/06* (2013.01); *A45C 13/02* (2013.01); *A45C 13/10* (2013.01); *A45C 2013/1015* (2013.01)

(58) Field of Classification Search

CPC ..... A47B 81/005; A47B 57/588; A47B 65/15; A47F 7/0021; A47F 5/005; B60R 7/14

USPC ..... 206/317; 211/64, 184

See application file for complete search history.

(56) References Cited

U.S. PATENT DOCUMENTS

| | | | | |
|---|---|---|---|---|
| 6,547,070 | B1 * | 4/2003 | Kolpin | F41C 33/06 190/102 |
| 7,025,203 | B2 * | 4/2006 | Schonenbach | F41C 33/06 206/315.11 |
| 7,325,681 | B2 * | 2/2008 | Schonenbach | A45C 11/24 206/315.11 |
| 7,726,478 | B2 * | 6/2010 | Potterfield | F41A 35/00 206/317 |
| 8,727,294 | B1 * | 5/2014 | Harms | F41A 23/18 206/317 |
| 2014/0183234 | A1 * | 7/2014 | Hudspeth | B60R 7/14 224/275 |

* cited by examiner

*Primary Examiner* — King M Chu

(74) *Attorney, Agent, or Firm* — Richards Patent Law P.C.

(57) ABSTRACT

A firearm storage apparatus comprising a base including a first groove, a first storage panel removeably supported within the first groove, the first storage panel including a plurality of slots that traverse a face of the first storage panel and a plurality of adjustable straps, each strap mated to the first storage panel through two of the slots and adjustable in position along the first storage panel and adjustable in degree of tightness to secure a firearm to the first storage panel.

18 Claims, 12 Drawing Sheets

FIREARM STORAGE APPARATUS

BACKGROUND OF THE INVENTION

The present subject matter relates generally to a firearm storage and transport. More specifically, the present invention relates to a space efficient firearm storage and transport apparatus.

Firearms are an indelible part of American society. While controversial to some, firearms are pervasive throughout the United States and one topic most, if not all, can agree on is the need for firearms to be stored and transported in a safe manner. Currently, the methods for gun storage involve either storing or carrying the weapon inside or outside of a case. Depending on local laws, the carry of firearms outside of a case in public may be prohibited and most gun safety experts agree the safest way to carry and store a firearm is unloaded and locked in a case. When purchased from a manufacturer, some guns come with a case, but when buying a gun secondhand or when a gun is sold without a case by the manufacturer, there arises a need for gun cases which can accommodate and securely transport firearms of any make or model.

Presently, firearm cases most typically consist of hard-bodied cases with foam padding on the interior for smaller weapons like handguns, with larger weapons either being accommodated by a similarly built large hard-bodied cases or padded soft-bodied cases. These soft-bodied cases exist for the sake convenience and ease of transportation which are not pressing concerns when storing or transporting a single weapon, but when storing and transporting multiple weapons, the logistical challenge of accommodating multiple hard-bodied cases becomes quite difficult. Each hard-bodied handgun case is typically designed to be carried with one hand and have the approximate dimensions of 12"×8"×4" (inches). This means a gun owner can likely carry only two guns in separate cases comfortably at one time and must also find room to store the cases. Given the statistic that the average gun owner in the US owns around eight guns, the current method of utilizing individual hard-bodied or soft-bodied cases hampers the ability of most gun owners to safely carry and store their firearms.

Some firearm cases do allow the storage of multiple guns in one case but almost all of them are an extension of the hard-bodied case with foam padding design. These multi-gun storage cases, while more convenient to carry than multiple separate hard-bodied cases, are themselves larger than a single weapon storage case and do not provide an efficient use of space when storing or transporting the guns. Gun case manufacturers are clearly aware of the need for multi-gun storage but there is currently no existing art which teaches a method for storing multiple firearms in a way which minimizes the space required to, in turn, store the firearms case. Accordingly, there is a need for an apparatus adapted to store and transport multiple firearms safely and in a space efficient manner.

BRIEF SUMMARY OF THE INVENTION

To meet the needs described above and others, the present disclosure provides an apparatus adapted to store and transport multiple firearms safely and in a space efficient manner.

In a preferred embodiment, the apparatus consists of a storage base, storage panels, and storage case. The storage base may be a rectangular piece of hard material approximately two inches in height with a series of grooves cut into the top side of the base. The grooves may be set, at a minimum, the width of a handgun apart from each other and are themselves cut to a width that allows a storage panel to slide and sit in the groove. The grooves may travel the entire length of the base, which is a length equal to or less than that of the storage panels. On the bottom of the storage base, the side opposite to the grooves, there may be rubber feet attached to the base which prevents the base from sliding. The storage panels may also be constructed of hard material and may be rectangular in shape, but are much thinner in width than the base at one fourth of an inch. The panels may also be much taller than the base, with dimensions of approximately twelve inches high and fourteen inches long. As mentioned previously, the panels may be adapted to slide in and out of the grooves in the base and when placed into the base will stand upright with the faces of the panels being perpendicular to the top side of the base.

In this embodiment, the storage panels may also be designed to accommodate two handguns a piece strapped to them. This is accomplished by the use of horizontal and vertical slots which may be cut through the one fourth of an inch wide panel. The slots allow a user to strap two handguns to the storage panel with the use of cinch straps and spacers which fit through the slots and securely fasten the guns to the panel. The storage case may be a soft bodied bag designed to be carried over the shoulder. For example, the storage case may feature a zip top and shoulder strap. On the inside of the bag there may be rows of foam padding with space in-between the rows forming compartments which can accommodate one storage panel per space.

In another embodiment of the gun storage apparatus, the storage panels and base from the previously discussed handgun storage embodiment may be enlarged to accommodate and store both handguns and long guns. In this physically larger embodiment, the base and panels may have the same relative proportions as the smaller handgun embodiment. In contrast to the handgun panel however, both handguns and long guns may be strapped securely to the storage panel by use of cinch straps and spacers. This is accomplished by the use of horizontal and vertical slots which may be cut through the broad face of the panel, also seen in the handgun sized panel. This larger embodiment may feature many more slots cut into the panel when compared to the handgun panel. These extra slots allow for the storage of various sizes of guns with differing types of barrels, stocks, receivers, magazines, and grips. The larger panel may range in size from approximately sixteen inches tall and twenty five inches long to sixteen inches tall and fifty one inches long with the corresponding storage base being scaled to accommodate these proportions. Additionally, in this embodiment of the gun storage apparatus, the gun storage case may be scaled up from the handgun embodiment to accommodate both the larger panels and smaller panels.

Yet other embodiments of the invention exist including a firearm storage apparatus comprising a base including a first groove, a first storage panel removeably supported within the first groove, the first storage panel including a plurality of slots that traverse a face of the first storage panel, and a plurality of adjustable straps, each strap mated to the first storage panel through two of the slots and adjustable in position along the first storage panel and adjustable in degree of tightness to secure a firearm to the first storage panel.

This embodiment may also include a second storage panel removeably supported within a second groove in the base, the second storage panel including a plurality of slots that traverse a face of the second storage panel; one or more spacers removeably and adjustably secured to the panel to further support the firearm secured to the first storage panel; and rectangular storage panels. This embodiment may yes also include a soft-bodied or hard-bodied case for the base and/or a carrying case including compartments sized to receive the first storage panel when removed from the base.

Another embodiment features a firearm storage system comprising a base including a first groove, a first storage panel removeably supported within the first groove, the first storage panel including a plurality of adjustable straps mated to the first storage panel and adjustable to secure a firearm to the first storage panel, and a carrying case including a first compartment sized to receive the first storage panel when removed from the base.

This embodiment may also feature adjustable straps which comprise a holster, adjustable straps which are cinch straps including a releasable closure, and each strap mated to the first storage panel through two of a plurality of slots located in the face of the first storage panel and adjustable in position along the first storage panel. Spacers which are removeably and adjustably secured to the panel to further support the firearm secured to the first storage panel, a second storage panel removeably supported within a second groove in the base, the second storage panel including a plurality of slots that traverse a face of the second storage panel, each strap mated to the first storage panel through two of a plurality of slots located in the face of the first storage panel and adjustable in position along the first storage panel, and spacers which are removeably and adjustably secured to the panel to further support the firearm secured to the first storage panel may also be included in this embodiment.

An object of the present invention is to provide a solution to the problem of safely storing and transporting a large number of firearms in a space efficient manner. With guns being a popular part of American culture and the average gun owner owning multiple guns, there is a need for gun owners to be able to carry and store their firearms in an efficient, safe, and subtle manner.

An advantage of the invention is that it provides users with a space efficient apparatus which can store a multitude of firearms in a compact space compared to traditional gun cases and gun racks. This makes safe gun ownership easier to accommodate and gun owners more likely to practice safe storage methods.

Another advantage of the invention is that is provides convenience for storing and transporting guns. Normally, a gun owner with several different firearms would have to open and close many different weapon cases and reorganize them when they wished to use different guns. Additionally the owner would have to keep track of where each weapon was located, but with this invention the user may freely swap out which guns they wish to carry and can easily take inventory of where each of their guns are located.

Yet another advantage of the invention is that it allows for gun storage and transport in a clandestine manner. A gun owner need not store and carry several bulky gun cases with him when using this invention. The use of a compact carrying case for several guns allows the gun owner to not draw attention to themselves in public and also to not disturb the public by carrying large, and what some may find as threatening, firearm cases.

Still yet another advantage of the invention is that the user no longer has to purchase multiple firearm cases. The design of the invention allows it to be expanded so a user can safely store and transport any new guns they acquire without having to purchase or otherwise acquire a case for their new firearm.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
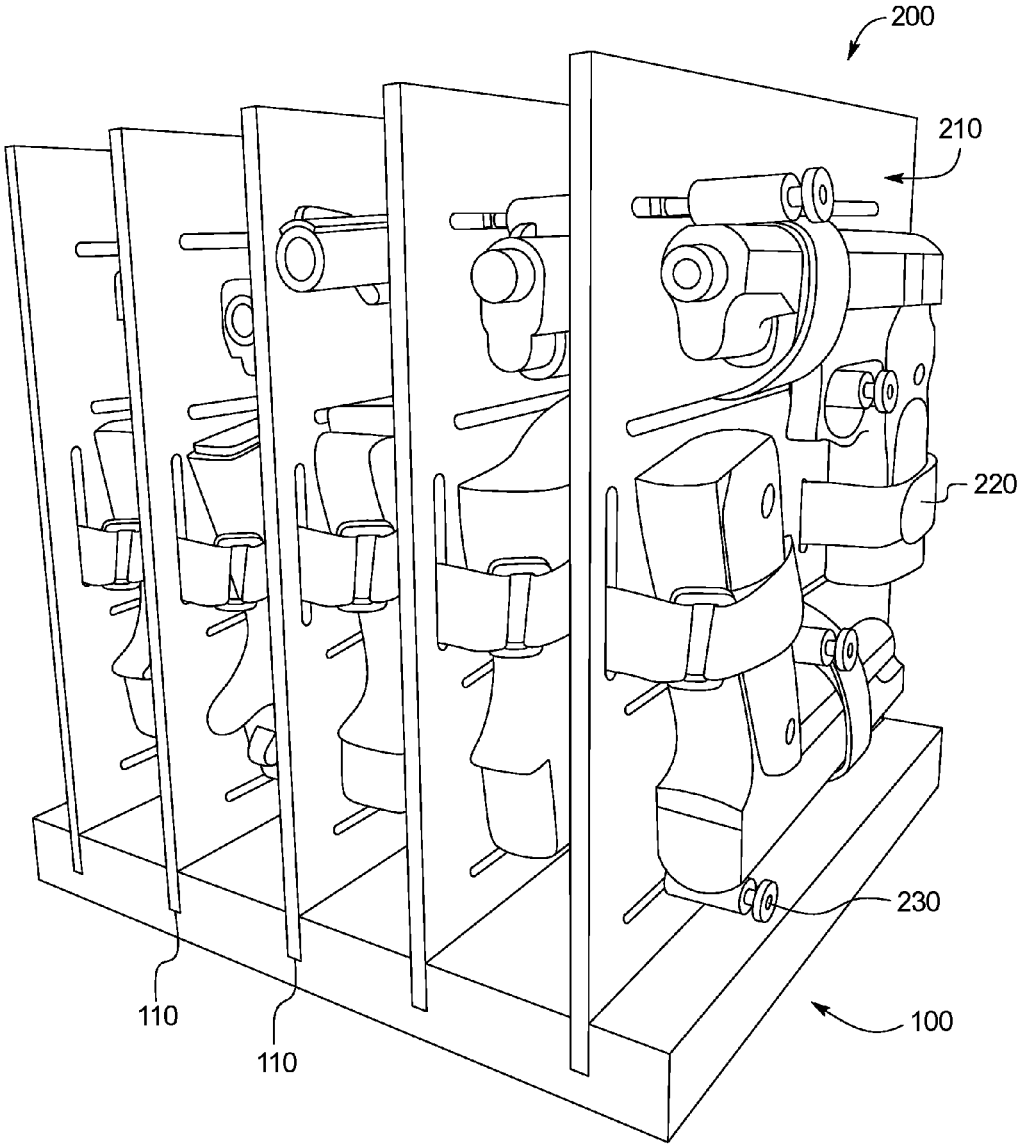
FIG. 1 is a perspective view of the storage panel sitting in the storage base.

FIG. 1 illustrates an example of a perspective view of the storage panel 200 sitting in the storage base 100. As shown in FIG. 1, the storage panel 200 may sit in grooves 110 of the storage base 100. Further shown in FIG. 1, two pistols may be strapped to the storage panel 200 via cinch straps 220 which fit through slots 210 cut in the panel 200. The pistols may be further secured by moveable spacers 230 which may be positioned in the slots 210.

Figure 2A:
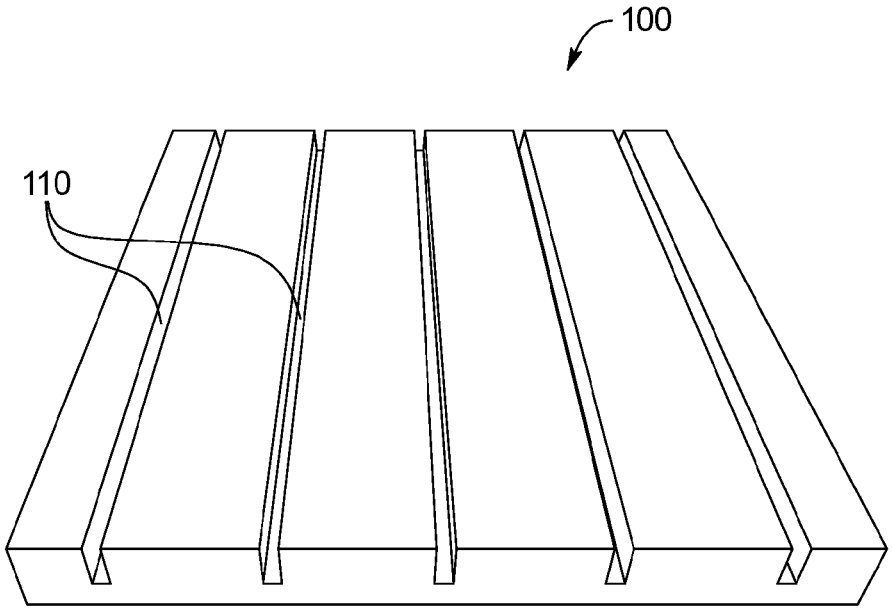
FIG. 2A is an alternative perspective view of the storage base.

FIG. 2A illustrates an alternative prospective view of the storage base 100. As shown in FIG. 2A, the base 100 may include a series of parallel grooves 110 cut along the entire length of the top side of base 100 that may be spaced, at minimum, the width of a handgun apart. In the non-limiting example shown, the series of grooves 110 amounts to five grooves 110 in total cut into the base 100.

Figure 2B:
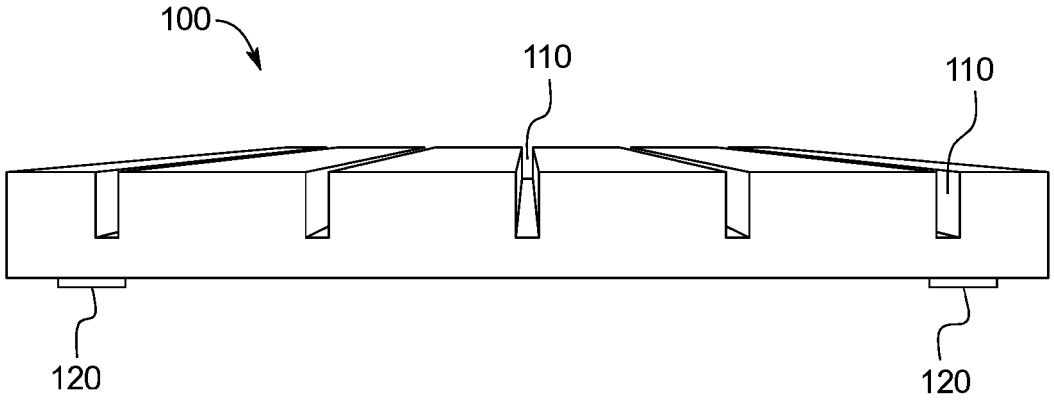
FIG. 2B is a side view of the storage base.

FIG. 2B illustrates a side view of the storage base 100. As shown in FIG. 2B, the grooves 110 may be cut to a depth of approximately one half the height of the storage base 100. Also shown in FIG. 2B, rubber feet 120 may be attached to the bottom of the base 100. The rubber feet 120 permit the base 100 to potentially be placed securely on a smooth surface such as a shelf in a gun locker.

Figure 2C:
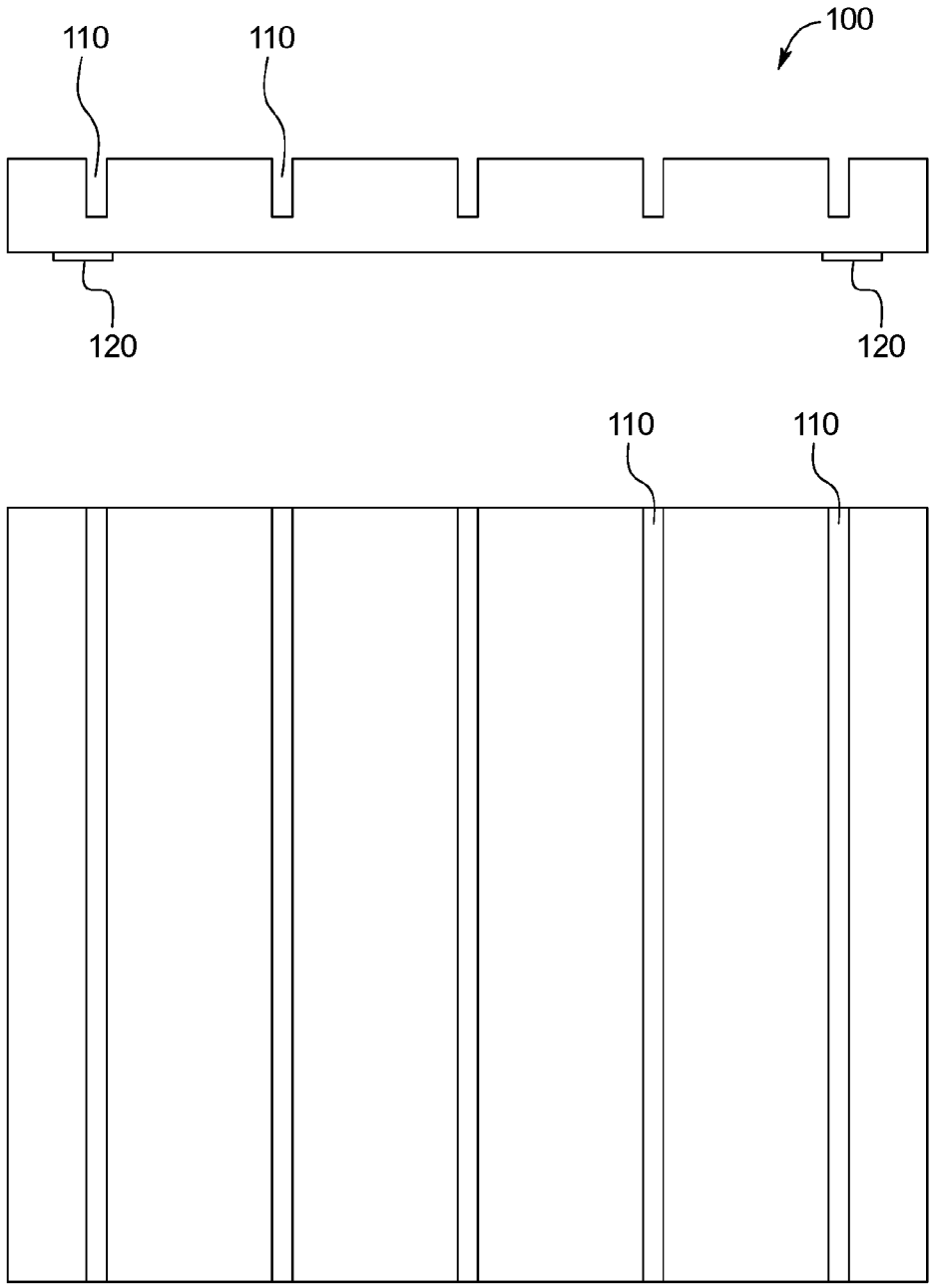
FIG. 2C is a diagram that highlights the various features of the storage base.

FIG. 2C is a diagram which highlights the features of the storage base 100. As shown in the diagram, the base may include grooves 110 cut into the top side of the base 100 and rubber feet 120 attached to the bottom of the base 100.

Figure 3A:
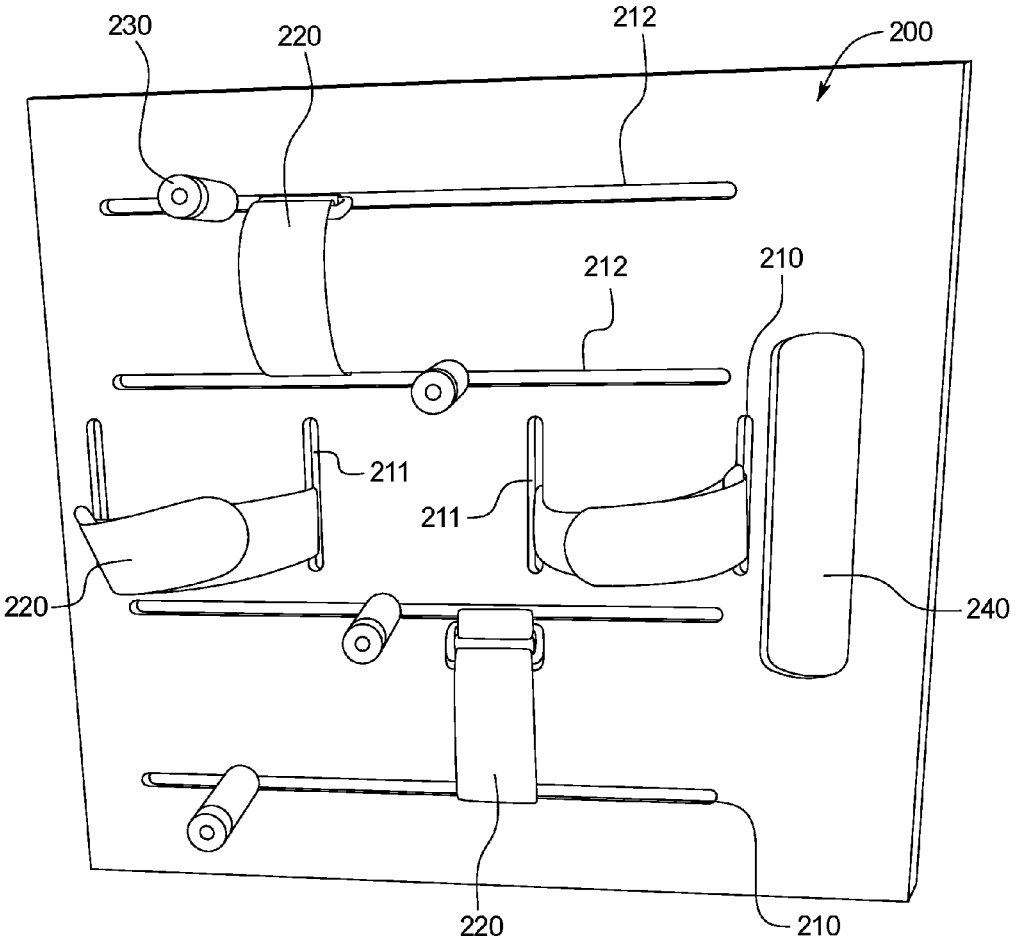
FIG. 3A is a front view of an unoccupied storage panel.

FIG. 3A illustrates a front view of the storage panel 200. As shown in FIG. 3A, a handle hole 240 may be cut approximately one inch from the end of the panel 200. The handle hole 240 may be rectangular in shape with beveled corners and approximately two inches wide by five inches long. The handle hole 240 may be positioned towards the middle of the length of the panel 200. Further shown in FIG. 3A, there are also slots 210 cut into the storage panel 200. The slots 210 may come in two varieties, vertical slots 211 and horizontal slots 212. The vertical slots 211 may be approximately three inches in length by one eight of an inch wide and positioned towards the middle of the length of the panel 200 similar to the hand hole 240. There may be two sets vertical slots 211 equating to four individual vertical slots 211 in total, with space between the two slots 211 in each set to potentially accommodate a pistol handle being strapped between the two slots 211. There may also be two sets of horizontal slots 212 amounting to four individual horizontal slots 212. The horizontal slots 212 may be approximately nine inches wide by one eight of an inch in length. The sets of horizontal slots 212 may be positioned above and below the vertical slots 211 and potentially set wide enough apart to accommodate a pistol barrel being strapped between the two slots 212 in each set. The horizontal 212 and vertical 211 slots may be positioned on the panel 200 relative to each other, beginning about a half inch down from the hand hole 240. The positioning of the slots 210 is done so that two pistols may be strapped onto the panel 200 at the same time forming a rough square. This may be accomplished by an approximately three inch gap between the two sets of vertical slots 211, allowing two pistol handles to sit within the two sets of slots 211, with one of the pistol barrels strapped in the horizontal slots 212 located above the vertical slots 211 and the other pistol barrel to be strapped in the horizontal slots 212 located below the vertical slots 211. Still further shown in FIG. 3A, cinch straps 220 may fit through the slots 210 and spacers 230 may sit in the vertical slots 212.

Figure 3B:
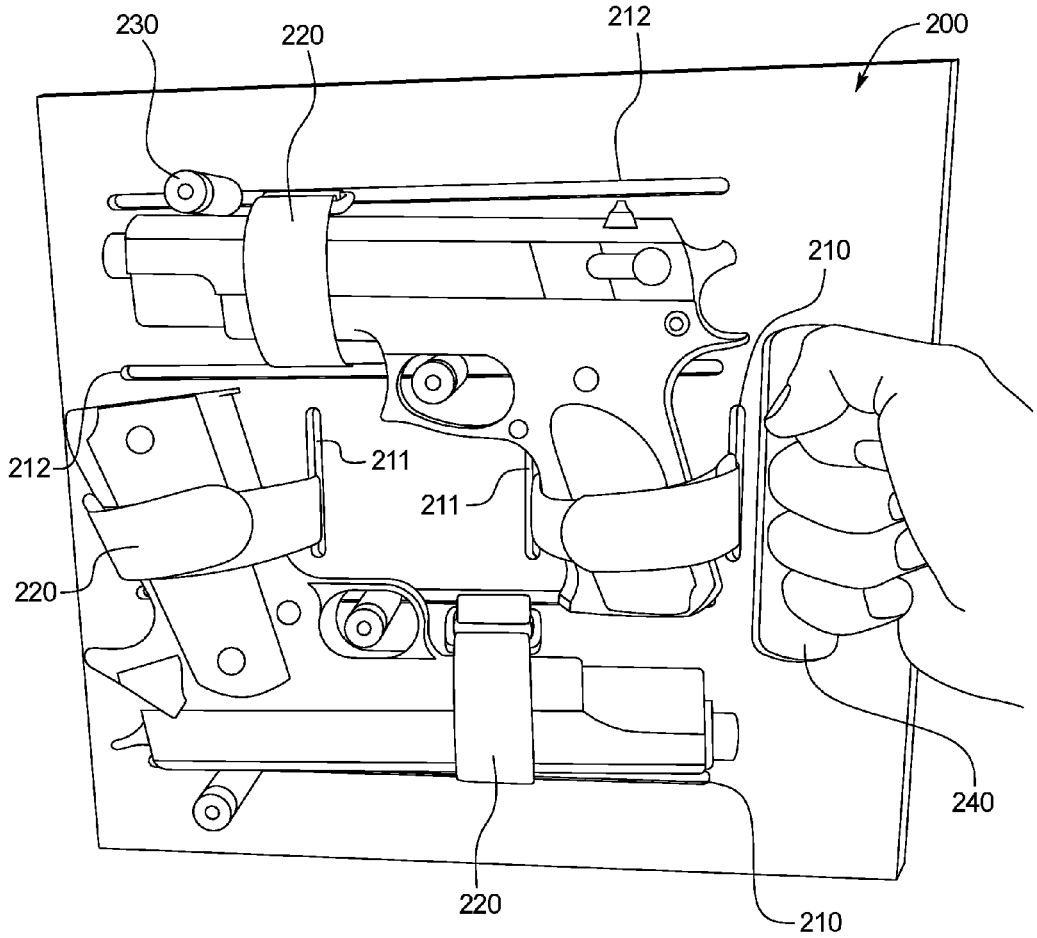
FIG. 3B is a front prospective view of a fully occupied storage panel.

FIG. 3B illustrates a front prospective view of a fully occupied storage panel 200. As shown in FIG. 3B, the handle hole 240 may accommodate the hand of an adult human. Further shown in FIG. 3B, the storage panel 200 may securely hold two pistols utilizing cinch straps 220 and spacers 230. The cinch straps may be fed through the slots 210 and the spacers 230 may be positioned along the horizontal slots 212. One spacer 230 may be positioned within the trigger guard of the pistol while the other spacer 230 may sit above the barrel. The cinch strap 220 may be adjustable via one or more hook and loop fastener, snap buttons, adjustable clasps, etc. It should also be noted the cinch straps 220 are show as rectangular straps of flexible material in this embodiment, but firearms may be attached to the panel 200 by any adjustable means of attachment of a firearm to the panel 200 which is not permanent including holsters (as shown in FIG. 3D, etc.).

Figure 3C:
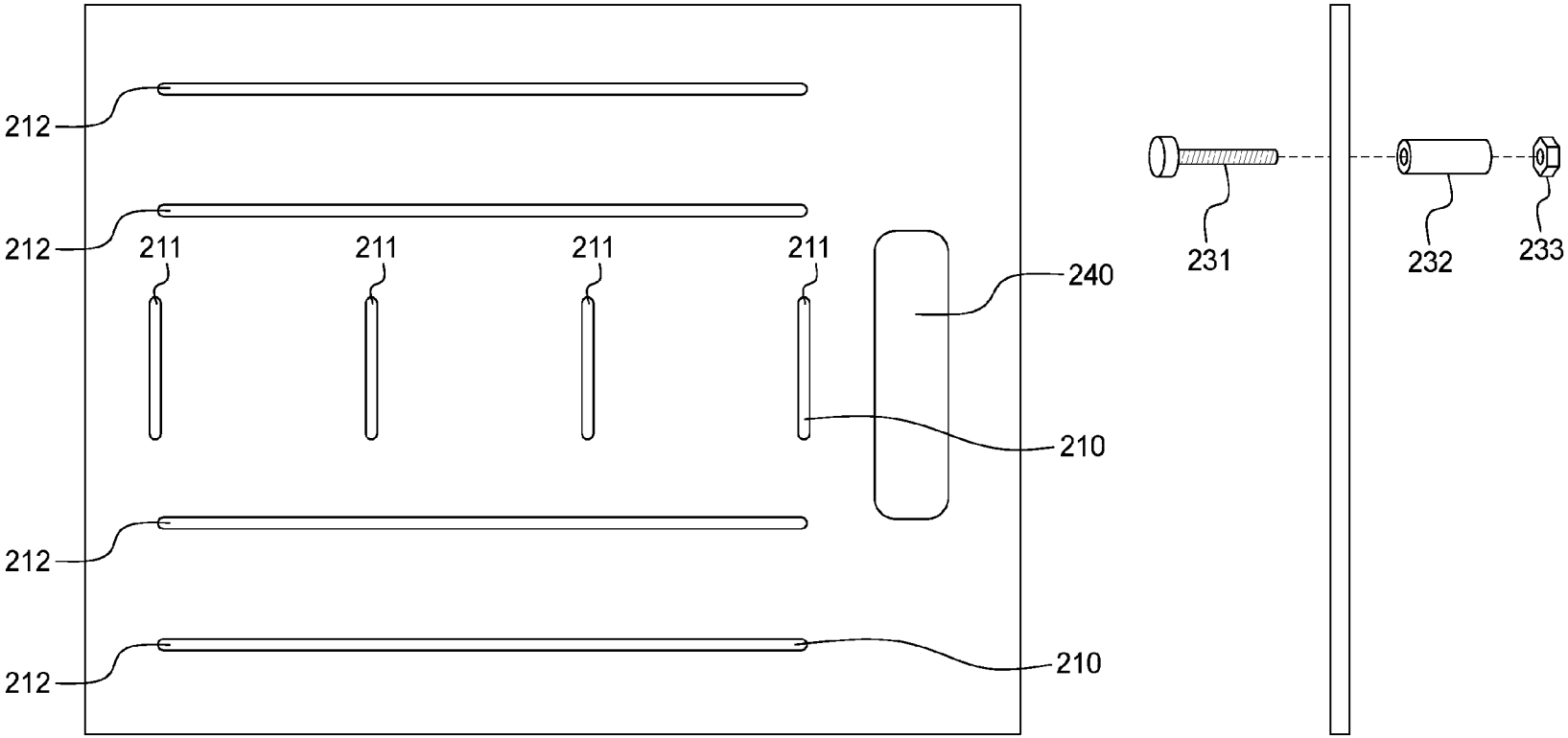
FIG. 3C is a diagram that highlights the various features of the storage panel.

FIG. 3C is a diagram that highlights the various features of the storage panel 200. The relative size of the handle hole 240 and the two types of slots 210: vertical 211 and horizontal 212, are shown. Additionally shown in FIG. 3C is a breakdown of the potential components of the spacer 230. The spacer 230 may consist of a screw 231, hollow spacer 232, and nut 233. The screw 231 may fit through the slots 210 in the panel 200. When placed into a slot 210, the head of the screw 231 may rest against the back side of the panel 200 while the threaded portion of the screw 231 may extend from the front side of the panel 200. The threaded portion of the screw 231 may fit within the cylindrical hollow spacer 232 with some of the threaded portion still being exposed. This exposed threaded portion of the screw 231 may fit into complimentary threads on the nut 233, allowing the component parts of the spacer 230 to be tightened securely to the panel 200.

Figure 3D:
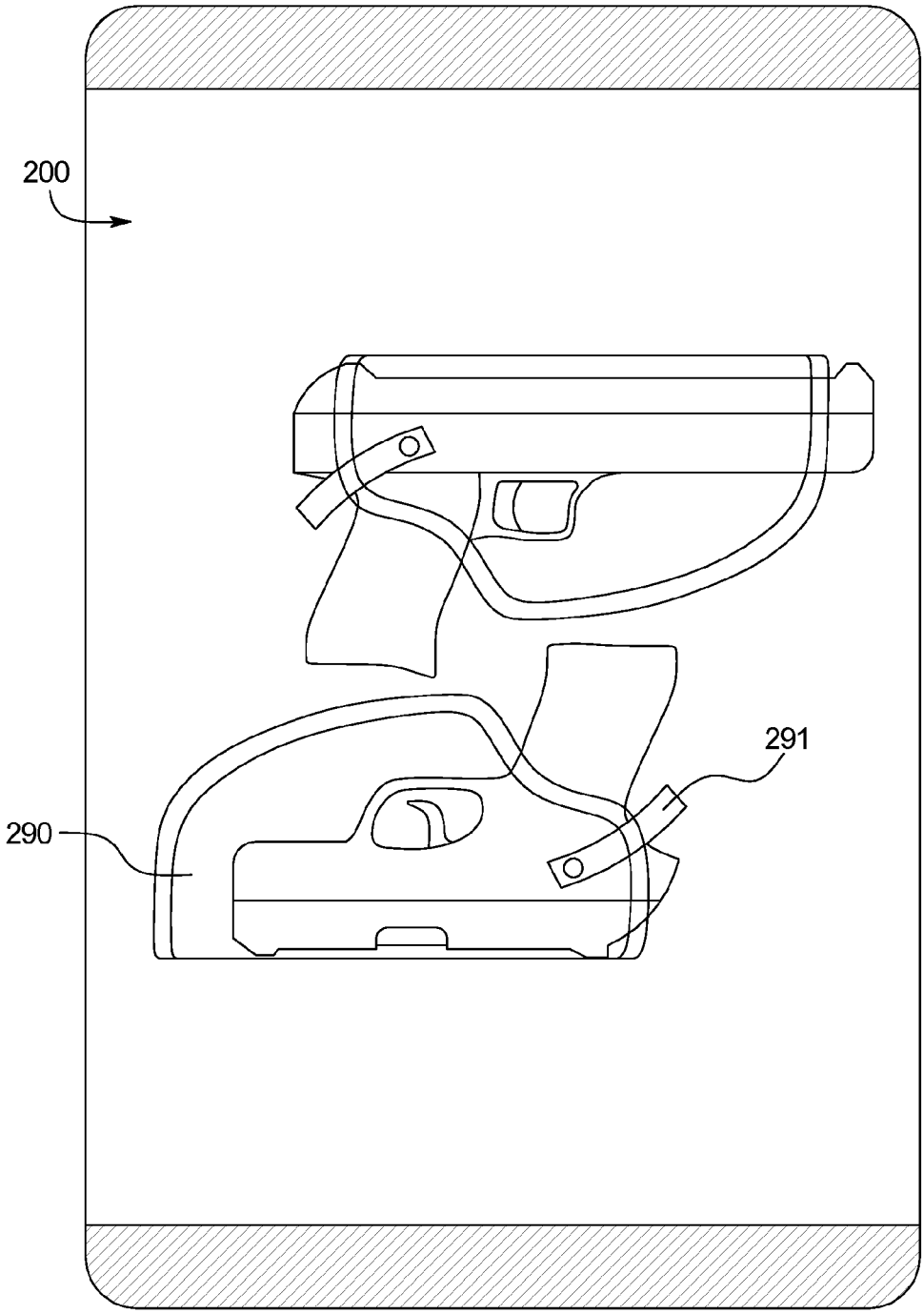
FIG. 3D front view of an occupied storage panel featuring a holster.

FIG. 3D is a front view of an occupied storage panel 200 featuring a holster 290. As shown in FIG. 3D, there are other embodiments of the storage panel 200 discussed in FIGS. 3A-3C. In this embodiment, firearms are secured to the panel 200 via a holster 290. The holster 290 may be integral with the panel 200, secured to the panel 200 via slots 210 (shown in FIGS. 3A-3C) and the use of cinch straps 220 (also shown in FIGS. 3A-3C), or secured to the panel 200 by another means which secures the holster in place for transport and storage. The holster 290 may feature a holster safety strap 291 which holds a firearm securely in the holster 290. The panel 200 shown in FIG. 3D also features hook and loop fastener strips 280 integral with or secured upon the panel 200 at various points on the face of the panel 200 in order to enable a magazine storage cuff 250 (illustrated in FIGS. 3E-3F) or other accessories to be affixed to the panel 200.

Figure 3E:
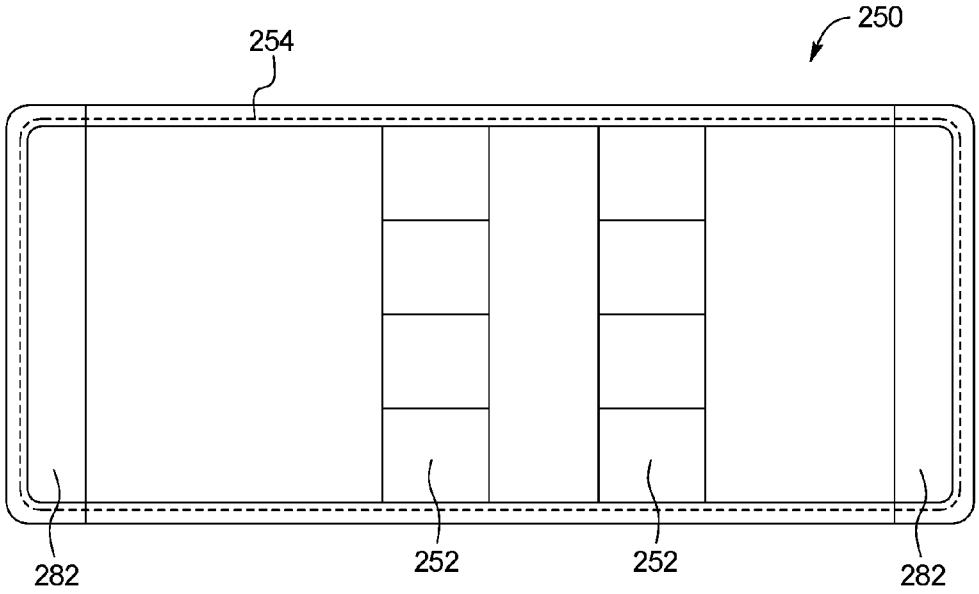
FIG. 3E is a front view of a magazine storage cuff.

FIG. 3E is a front view of a magazine storage cuff 250. As shown in FIG. 3E, a magazine storage cuff 250 matches up to the length of the storage panel 200 featuring hook and loop fastener discussed in FIG. 3D. The equal lengths of the panel 200 and cuff 250 allow the hook and loop fastener strips 280 on the panel 200 to align with complementary placed hook and loop fastener strips 281 so that the strips 280, 281 enable the cuff 250 to be affixed to the panel 200 (e.g., one of the strips 280 or 281 ifs the "hook" side of the hook and loop fastener while the other side has the fabric side which receives the hooks). The cuff 250 features a series of elastic bands 252 upon one of its faces which can each accommodate firearms magazines, accessories, or other equipment. Piping 254 encloses the perimeter of the cuff 250 holding the hook and loop fastener 281, bands 252, and cuff 250 securely together.

Figure 3F:
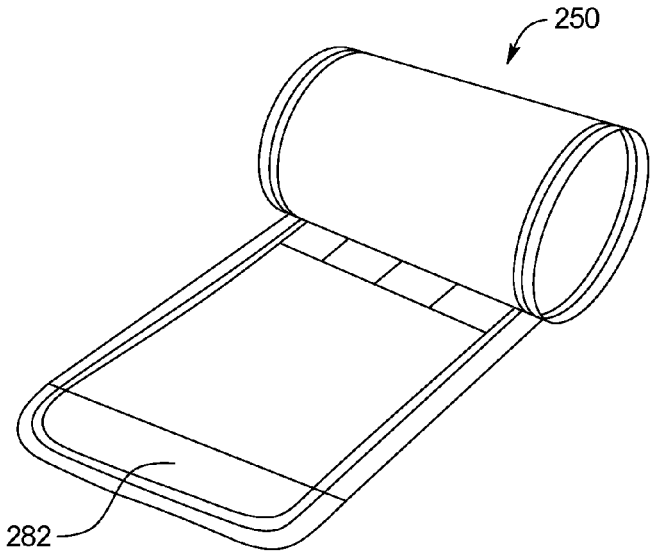
FIG. 3F is a perspective view of the magazine storage cuff rolled upon itself.

FIG. 3F is a perspective view of the magazine storage cuff 250 rolled upon itself. As shown in FIG. 3F, the magazine storage cuff 250 may be constructed of flexible materials (e.g., nylon) which enable it to be secured to the panel 200 (discussed in FIGS. 3D-3E) and also rolled upon itself (partially or fully) for ease of transport and handling when not affixed to the panel 200. One of the hook and loop fastener strips 281 of the cuff 250 may be used to secure the cuff 250 in its rolled state.

Figure 4B:
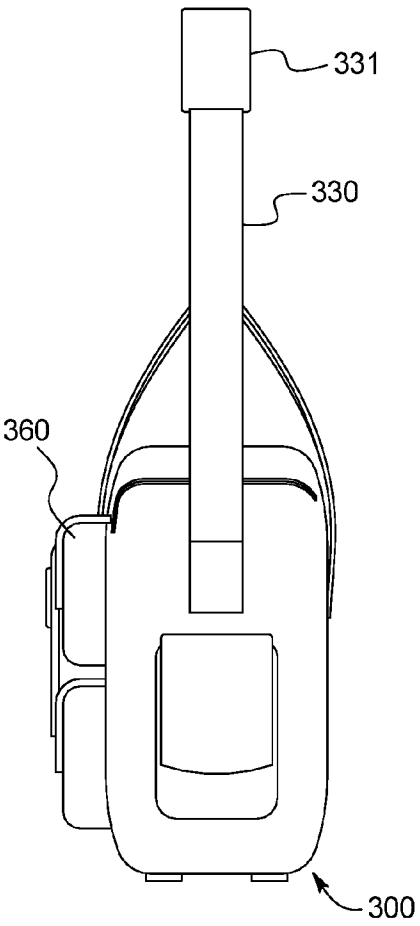
FIG. 4B is a side view of the exterior of the storage case.
Figure 4A:
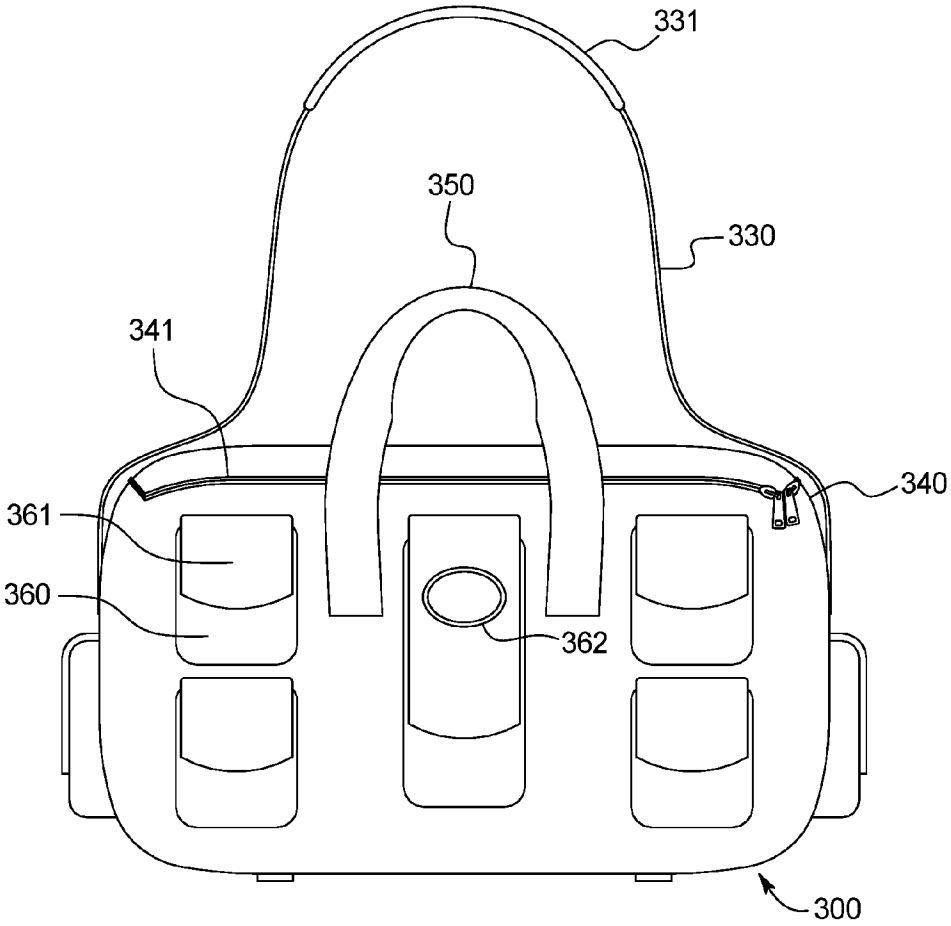
FIG. 4A is a front view of the exterior of the storage case.

FIG. 4A is a front view of the exterior of the storage case 300. As shown in FIG. 4A, the soft bodied case (or bag) 300 may include a carry handle 350 to allow for easier transportation of the case 300. The exterior of the case 300 may also feature a number of pouches 360 for additional storage. The pouches 360 may be secured by a closure 361 (hook and loop fastener, snap buttons, etc.) and the face of one or more of the pouches 360 or bag 300 itself may feature a badge 362 used to brand the case 300, identify its owner, etc. The interior of the case 300 may be accessible via a zip top lid 340—opened and closed by one of more zippers 341.

FIG. 4B is a side view of the exterior of the storage case 300. As shown in FIG. 3B, each side of the exterior of the case 300 may feature a portion of a shoulder strap 330 attached to allow for easier transportation of the case. The shoulder strap 330 of this embodiment features a leather shoulder pad 33 for added comfort when carrying the case 300. This view of the exterior of the case 300 also highlights the pouches 360 (which may be held closed by a secure closure 361; either hook and loop fastener, snap buttons, or any other closure securing functionality as shown in FIG. 4A), and also demonstrates the potential positioning of the rigid feet 370 from a side view.

Figure 4C:
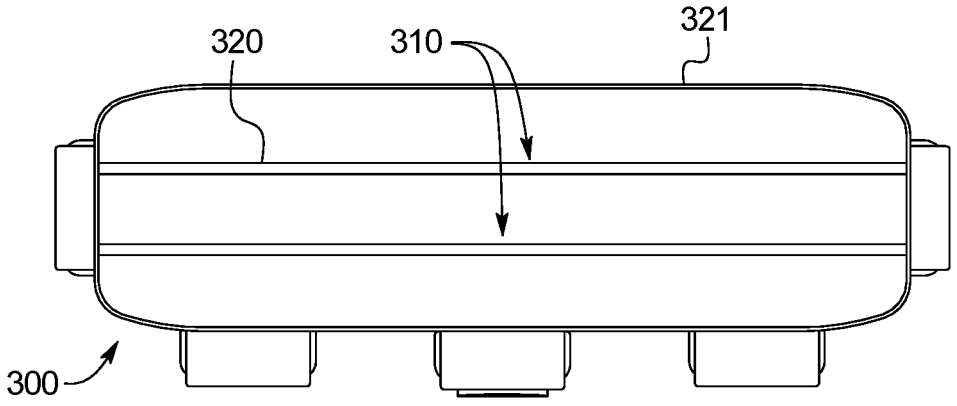
FIG. 4C is a top view of the interior of the storage case.

FIG. 4C is a top view of the interior of the storage case 300. As shown in FIG. 4C, the interior of the storage case 300 may consist of panel compartments 310 and padded dividers 320. The space between padded dividers 320 may create the compartments 310, the dimensions of these compartments being adequate to accommodate one or more storage panel 200 each. Along with the padded dividers 320, all other surfaces of the interior of the case 300 may be padded via peripheral padding 321 to protect and secure transported firearms.

Figure 4D:
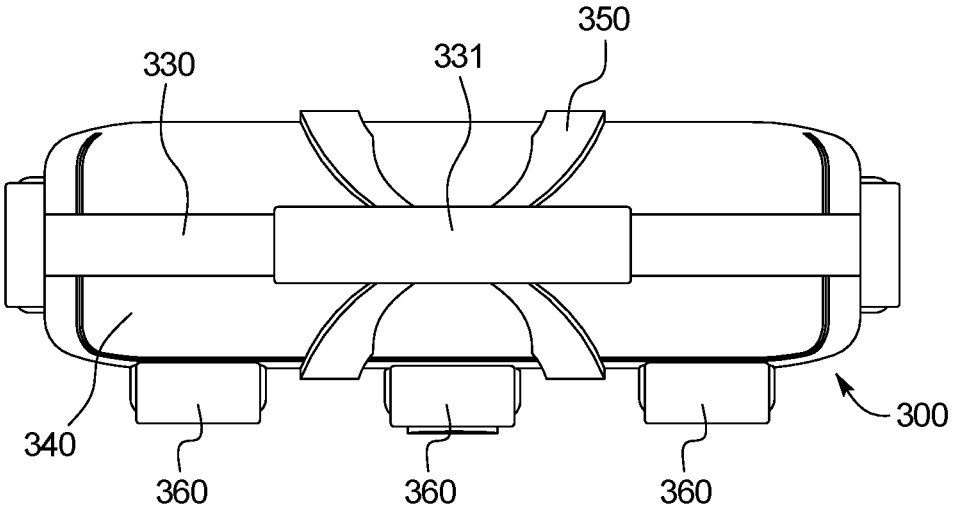
FIG. 4D is a tope view of the storage case.

FIG. 4D is a tope view of the storage case 300. As shown in FIG. 4D, the case 300 is topped with a zippered lid 340 which spans the length and width of the case 300. Pouches 360 adorn three sides of the case 300, with one of the longer sides of the case 300 without any exterior pouches 360 to allow this side of the case 300 to be held comfortably against the human (or animal) body when carried. The carry handles 350 are shown positioned beneath the shoulder strap 330 and its shoulder pad 331.

Figure 5:
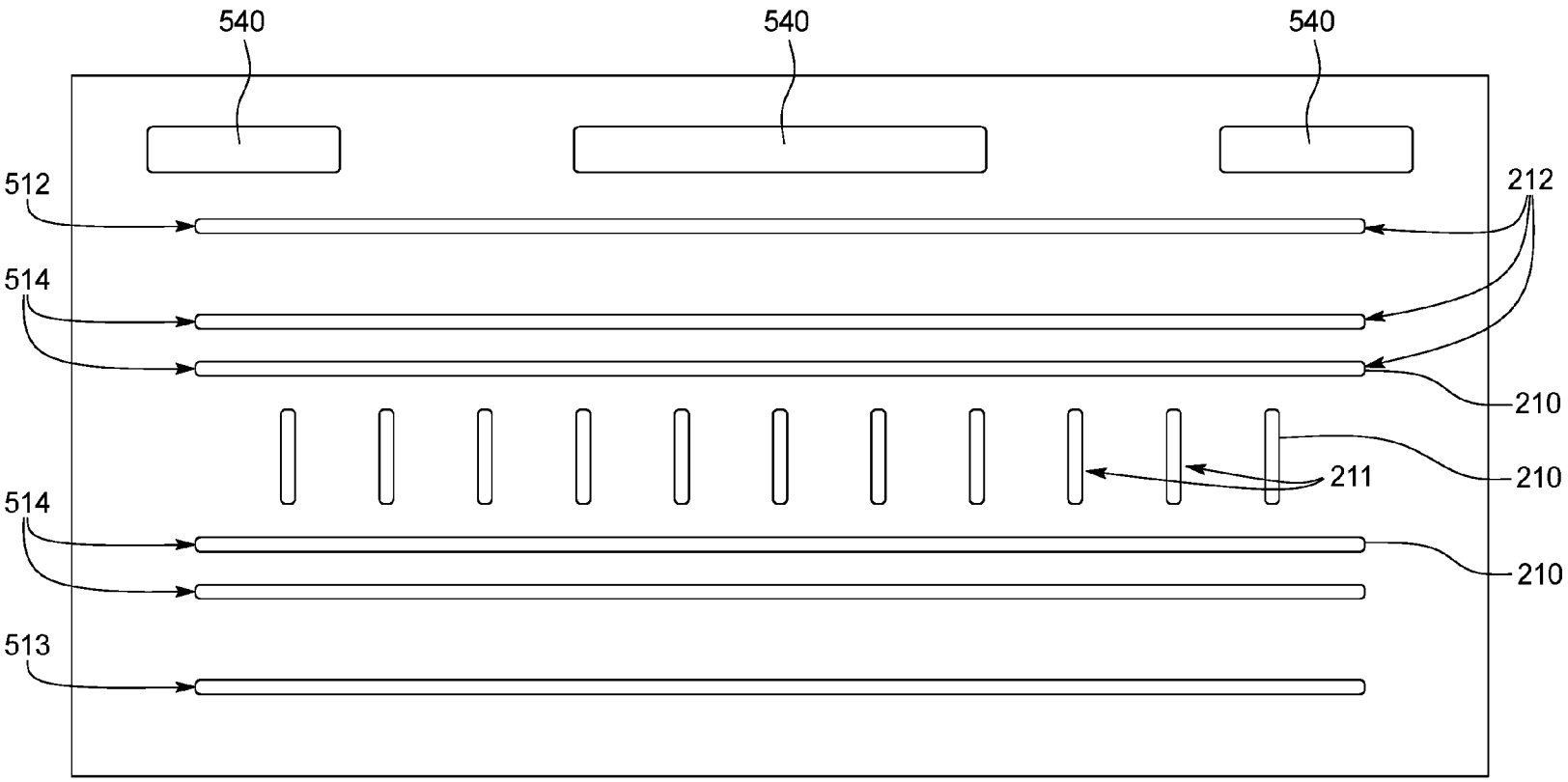
FIG. 5 is a diagram of a larger gun storage panel.

FIG. 5 is a diagram of a larger gun storage panel 500. As shown in FIG. 5, the larger gun storage panel 500 may be a scaled up version of the handgun panel 200. The larger panel 500 may feature both vertical slots 211 and horizontal slots 212 similar to the slots 210 of the handgun panel 200. The larger panel 500 may however feature more slots 210 than the handgun panel 200, which may include six horizontal 212 and eleven vertical 211 slots. The slots 210 are positioned relative to each other like the handgun panel 200 to allow guns to be strapped to the panel 500. The vertical slots 211 may be cut along the midline of the panel 500, with the horizontal slots 212 positioned above and below the vertical slots 211 in sets of three. The top most slot 512 in the top set and bottom most slot 513 in the bottom set of horizontal slots 212 may be spaced apart from the other two horizontal slots 514 in each set with enough distance to allow the multitude of different barrels and/or stocks found on long guns to be securely strapped to the panel 500 in this space. The other two horizontal slots 514 in each set may be placed relative to the vertical slots 211 to allow handguns to be strapped to the panel 500 with the barrel of the pistol resting between the sets of horizontal slots 514 and the handle between the vertical slots 211. Also shown in FIG. 5, the larger panel 500 may have a series of handle holes 540 cut near the top of the panel to allow the panel 500 to be picked up with one hand or two.

Figure 6A:
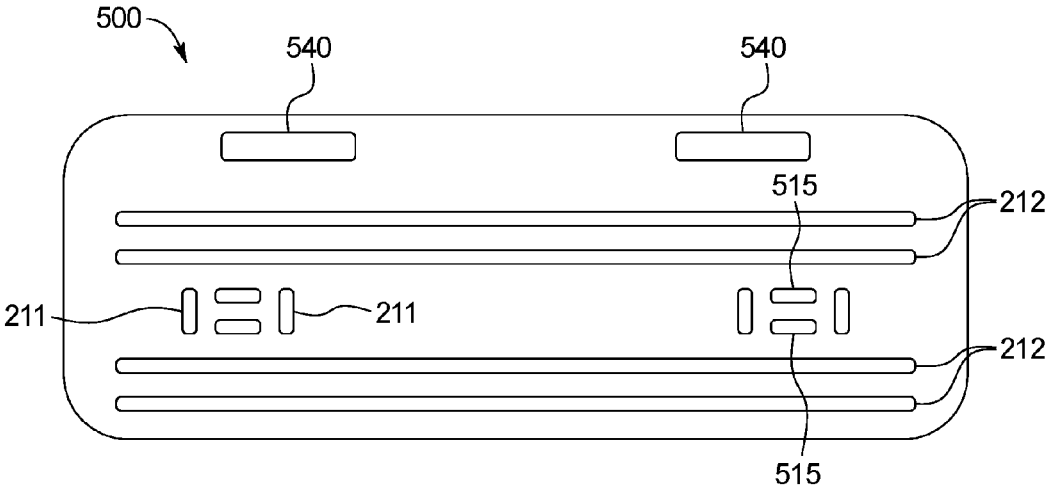
FIG. 6A is a diagram of a larger gun storage panel with a different slot configuration.

FIG. 6A is a diagram of a larger gun storage panel 500 with a different slot 210 configuration. As shown in FIG. 6A, the larger gun storage panel 500 may feature an arrangement of slots 210 which can accommodate long guns with different types of stocks or grips. This may be achieved by using sets of long horizontal slots 212, vertical slots 211, and short horizontal slots 515. The long horizontal slots 212 may be cut in sets of two and positioned above and below the midline of the panel 500. The long slots 212 are cut relative to the vertical slots 211 and short horizontal slots 515 in a way that allows a long gun barrel to be strapped between the long slots 212 while the gun's grip or shoulder stock is secured by cinch straps fed through the vertical slots 211 and/or short horizontal slots 515. The vertical slots 211 and short horizontal slots 515 may be cut in sets of two and positioned along the midline of the panel 500. The vertical slots 211 and short horizontal slots 515 may be cut relative to each other to form a square, with a set of the short vertical slots 515 being two sides of the square and a set of vertical slots 211 forming the other two sides. One of these squares of slots (vertical slots 211 and short horizontal slots 515) may be placed towards each end of the length of the panel 500 along its midline allowing various types of long guns to be securely stored and carried. Also shown in FIG. 6A, the larger panel 500 may have a series of handle holes 540 cut near the top of the panel to allow the panel 500 to be picked up.

Figure 6B:
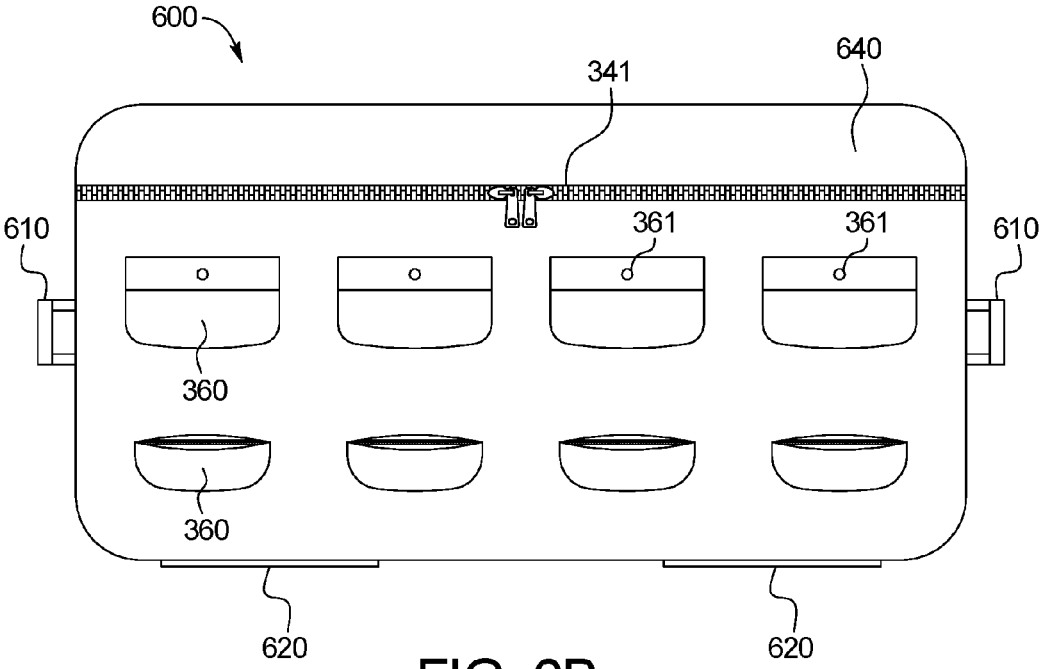
FIG. 6B is a diagram of the exterior of a larger gun storage case.

FIG. 6B is a diagram of a larger gun storage case 600. As shown in FIG. 6B, a larger gun storage case 600 may be roughly the shape of a large rectangular food cooler. This large rectangular shape may allow the case 600 to store both handgun 200 and long gun 500 storage panels. On the outside of the case 600, on each side, there may be a carry handle 610 to aid in transport of the case 600. On the bottom of the case 600, there may be rubberized feet 620 to ensure the case 600 can be securely positioned during transport and use. Also shown in FIG. 6B, the inside of the case 600 may be accessed via a zipper 341 which runs around the top of the case 600 securing the case lid 640. Pouches 360 may also adorn the outside of the case 600 and be secured by any number of secure closures 361 (hook and loop fastener, snap buttons, etc.).

It should be noted that various changes and modifications to the presently preferred embodiments described herein will be apparent to those skilled in the art. Such changes and modifications may be made without departing from the spirit and scope of the present invention and without diminishing its attendant advantages.

The invention claimed is:

1. A firearm storage apparatus comprising:

a base including a first groove;

a first storage panel removeably supported within the first groove, the first storage panel including a plurality of slots that traverse a face of the first storage panel; and a plurality of adjustable straps, each strap mated to the first storage panel through two of the slots and adjustable in position along the first storage panel and adjustable in degree of tightness to secure a firearm to the first storage panel;

wherein the base includes a second storage panel removeably supported within a second groove in the base, the second storage panel including a plurality of slots that traverse a face of the second storage panel.

2. The apparatus of claim 1 further comprising a spacer removeably and adjustably secured to the panel to further support the firearm secured to the first storage panel.

3. The apparatus of claim 2 comprising at least two spacers for each firearm secured to the first storage panel.

4. The apparatus of claim 1 wherein the first storage panel is rectangular.

5. The apparatus of claim 1 wherein the base is contained within a soft-bodied case.

6. The apparatus of claim 1 wherein the base is contained within a hard-bodied case.

7. The apparatus of claim 1 further comprising a carrying case including a first compartment sized to receive the first storage panel when removed from the base.

8. The apparatus of claim 7 wherein the carrying case further comprises a second compartment sized to receive a second storage panel.

9. The apparatus of claim 1 wherein the plurality of adjustable straps include four adjustable straps positioned to hold two firearms to the first storage panel.

10. A firearm storage system comprising:

a base including a first groove;

a first storage panel removeably supported within the first groove, the first storage panel including a plurality of adjustable straps mated to the first storage panel and adjustable to secure a firearm to the first storage panel; and a carrying case including a first compartment sized to receive the first storage panel when removed from the base;

wherein the base includes a second storage panel removeably supported within a second groove in the base, the second storage panel including a plurality of slots that traverse a face of the second storage panel.

11. The system of claim 10 wherein the adjustable straps comprise a holster.

12. The system of claim 10 wherein the adjustable straps are cinch straps including a releasable closure.

13. The system of claim 12 wherein the releasable closure includes a hook and loop fastener.

14. The system of claim 10 wherein each strap is mated to the first storage panel through two of a plurality of slots located in the face of the first storage panel and adjustable in position along the first storage panel.

15. The system of claim 14 wherein a spacer is removeably and adjustably secured to the panel to further support the firearm secured to the first storage panel.

16. The system of claim 10 wherein each strap is mated to the first storage panel through two of a plurality of slots located in the face of the first storage panel and adjustable in position along the first storage panel.

17. The system of claim 16 wherein a spacer is removeably and adjustably secured to the panel to further support the firearm secured to the first storage panel.

18. A firearm storage apparatus comprising:

a base including a first groove;

a first storage panel removeably supported within the first groove, the first storage panel including a plurality of slots that traverse a face of the first storage panel;

a second storage panel removeably supported within a second groove in the base, the second storage panel including a plurality of slots that traverse a face of the second storage panel;

a plurality of adjustable straps, each strap mated to the first storage panel through two of the slots and adjustable in position along the first storage panel and adjustable in degree of tightness to secure a firearm to the first storage panel; and a plurality of spacers removeably and adjustably secured to the panels to further support the firearms secured to the first storage panel and second storage panels.

* * * * *